United States Patent [19]

Dashew

[11] 3,939,234

[45] Feb. 17, 1976

[54] METHOD FOR SEALING AND STRIPPING A CONCRETE FORM

[75] Inventor: Stephen S. Dashew, Los Angeles, Calif.

[73] Assignee: Interform Inc., Compton, Calif.

[22] Filed: Aug. 14, 1972

[21] Appl. No.: 280,348

[52] U.S. Cl. ..... 264/31; 249/66 A; 264/335; 425/437

[51] Int. Cl.[2] ..... B28B 21/90

[58] Field of Search ..... 425/437–438; 249/175, 66, 187, 63; 264/335, 31

[56] References Cited

UNITED STATES PATENTS 3,151,374 10/1964 Kersten ..... 249/187 R 3,374,983 3/1968 Garretson et al. ..... 425/437

*Primary Examiner*—Francis S. Husar
*Assistant Examiner*—John McQuade
*Attorney, Agent, or Firm*—Lindenberg, Freilich, Wasserman, Rosen & Fernandez

[57] ABSTRACT

A device for sealing the air hole in a concrete form while concrete is poured over the form, including a cap of resilient material having a dome-like top and a cruciform shaft extending from the concave side of the top for reception in the air hole of the form. When the dome is pressed down to form a dimple therein, the fact that the dimple remains indicates that the shaft is firmly seated in the air hole.

1 Claim, 8 Drawing Figures

Fig. 1
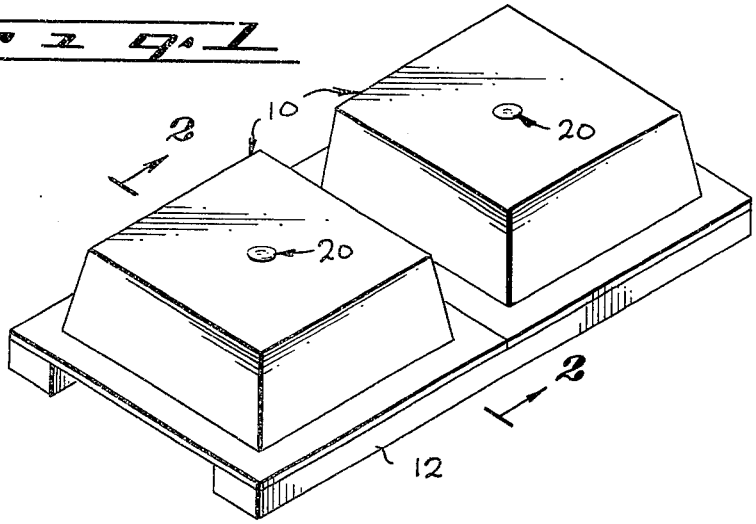
Fig. 2
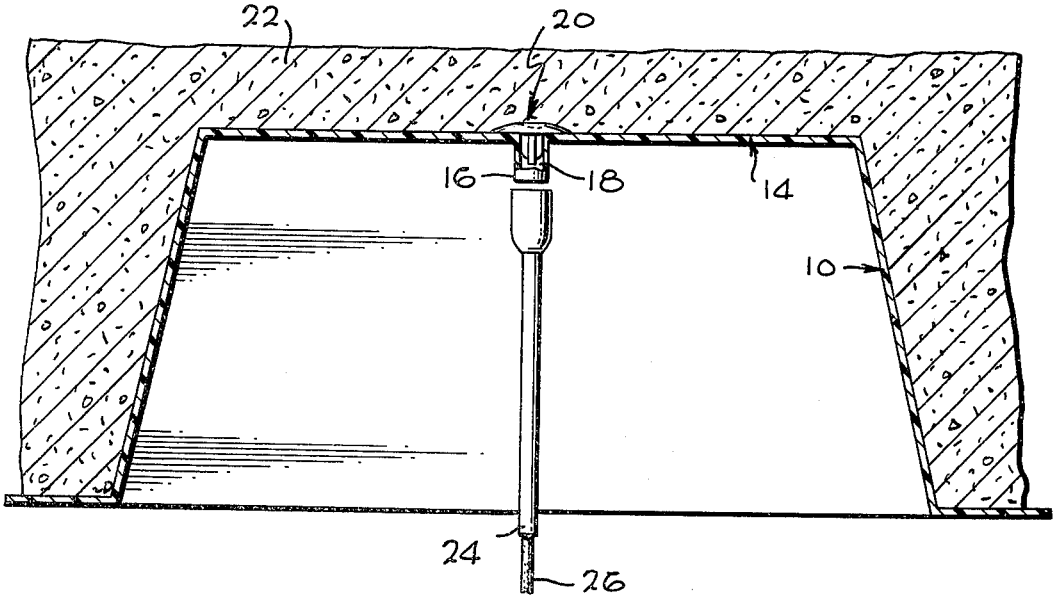
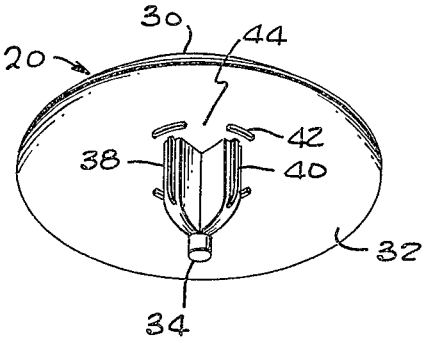
Fig. 3

Fig. 4
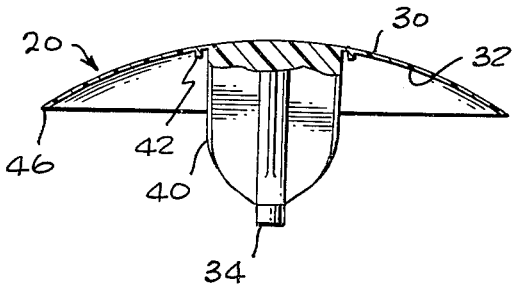
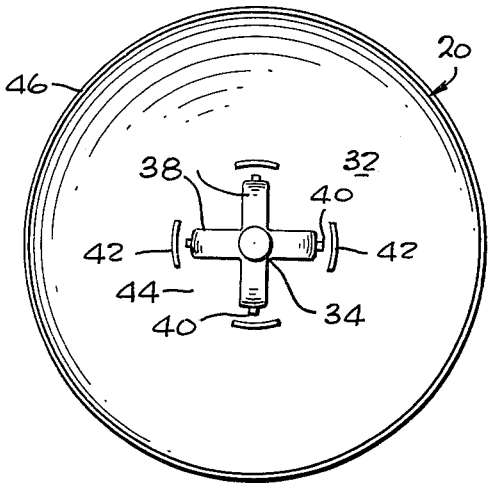
Fig. 5
Fig. 6
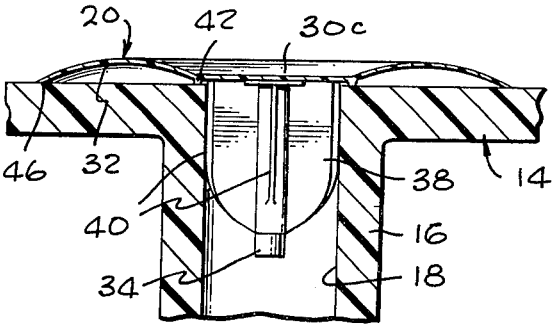
Fig. 8
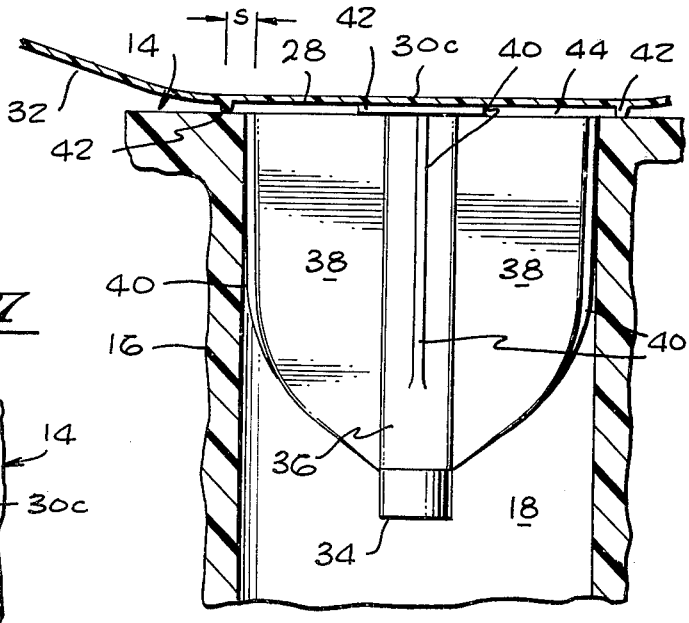
Fig. 7
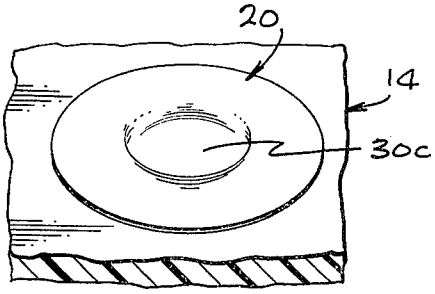

METHOD FOR SEALING AND STRIPPING A CONCRETE FORM

BACKGROUND OF THE INVENTION

This invention relates to a method for sealing the air hole in concrete forms.

Reusable concrete forms are sometimes provided with an air hole in the upper face of the form for facilitating removal of the form. After the concrete which was poured on the form partially sets, air is blown under pressure through the air hole to provide a layer of pressured air between the top of the form and the concrete. This pressured air shoves down the form by a small amount, which frees the form or loosens it enough to make freeing of the form easier. In using the concrete form, it is necessary to seal the air hole so that concrete does not leak through it before the concrete sets. various devices such as tape have been utilized to seal the air hole, but these have not been entirely satisfactory. The sealing device must be capable of rapid application and should be strongly enough held to prevent collapse under the weight of concrete while permitting reverse air flow during loosening, and it should permit an even distribution of air onto the upper face of the form in all directions from the air hole. Furthermore, a definite indication should be provided as to whether the device has been securely installed. An economical device that could securely seal the air hole and provide a definite indication as to whether it was properly installed, and which encouraged a uniform distribution of pressured air during release of the form, would facilitate the use of concrete forms.

SUMMARY OF THE INVENTION

In accordance with one embodiment of the present invention, a cap is provided which can be readily installed in the air hole of a concrete form, which indicates secure installation, and which facilitates even distribution of air during removal of the form from set concrete. The cap is constructed of resilient material and has a dome top and a shaft extending from the concave surface of the top. The shaft is designed to provide an interference fit with the wall of the air hole in the form so that the cap is securely held in place. When a workman presses down on the middle of the cap during installation, the domed top will remain depressed or dimpled at its center if the shaft is securely held in the air hole, thereby providing a definite indication of secure installation. The depression of the cap causes the rim of the top to make a good seal with the form around the air hole. The shaft has several arms radiating from its center, the space between the arms providing air conduits through which air can flow during removal of the form. Each of the arms has a narrow rib on its outside to provide a small compressible surface that permits a moderate interference fit with the walls of the air hole over a wider variation of air hole diameters. Several projections are formed on the concave side of the domed top which are spaced radially from the shaft, so that space is left for the outflow of air from the shaft to the upper surface of the form.

The novel features of the invention are set forth with particularity in the appended claims. The invention will best be understood from the following description when read in conjunction with the accompanying drawings.

BRIEF DESCRIPTION OF THE DRAWINGS

FIG. 1 is a perspective view of a portion of a concrete form structure set up for the pouring of concrete thereof, and with the caps of the invention installed on the forms;

FIG. 2 is a view taken on the line 2—2 of FIG. 1 after concrete has been poured over the forms, and showing how air pressure is utilized to remove the forms from set concrete;

FIG. 3 is a bottom perspective view of the cap of the invention which was shown in FIG. 1;

FIG. 4 is a sectional side view of the cap of FIG. 3;

FIG. 5 is a bottom view of the cap of FIG. 3;

FIG. 6 is a sectional view of the cap of FIG. 4, shown after installation in a concrete form and with the center of the cap top depressed;

FIG. 7 is a top perspective view of the cap in the configuration of FIG. 6; and

FIG. 8 is an enlarged view of a portion of the cap and form of FIG. 6.

DESCRIPTION OF THE PREFERRED EMBODIMENTS

FIG. 1 illustrates a group of pan-shaped forms 10 positioned on a deck 12 and which are utilized to construct a concrete floor with intergral beams. As also shown in FIG. 2, the form 10 has an upper wall 14 with a nipple 16 at the center that forms an air hole 18 through the form wall. A cap 20 constructed in accordance with the invention is positioned in the air hole to seal it. After concrete 22 is poured over the form and partially sets, the form 10 is removed for reuse. In order to remove the form, which may be highly resistant to removal, a wand 24 which is connected by a hose 26 to a high pressure air supply, is applied to the bottom of the nipple 16. Pressured air or other gas is then blown through the wand and therefore through the air hole 18 and between the upper wall 14 of the form and the concrete 22. This air pressure pushes down the form 10, which loosens it from the concrete so that the form can be pulled down the rest of the way without breaking.

The cap 20 which seals the air hole 18 is designed for rapid and secure installation in the form by a workman at the pouring site. As illustrated in FIGS. 3–8, the cap 20 includes a meniscus or dome shaped top with a convex upper surface 30 and concave lower surface 32, and also includes a shaft 34 of cruciform cross section along most of its length which extends from the center of the lower surface 32 of the top. The cap 20 is constructed of a resilient material such as polyethylene plastic, and may be economically formed by injection molding or the like. The shaft 34 is normally of a size for making an interference fit with the walls of the air hole 18 to securely hold the cap in place. When a workman presses down on the center 30*c* of the upper surface of the cap, the center will be deformed downwardly to form a dimple as indicated in FIGS. 6 and 7. The dimple will remain only if the shaft 34 is securely held in place so that the top of the cap cannot spring back to a more uniformly rounded domed shape. Thus, when a workman installs the cap and presses down the center portion, he can readily determine whether the cap is securely seated by noting whether the center of the dome remains dimpled. The depression of the center of the cap results in the periphery of the cap, at a land 46 thereat, pressing securely against the form, thereby providing a good seal against concrete. The dimpled cap acts like a spring constantly urging the periphery at 46 thereof against the form even if the form deforms slightly after concrete is poured over it.

The cruciform shaft 34 has a center portion 36 and four arms 38 radiating from the center portion. The recesses in the shaft resulting from the spaces between the arms, form air passageways and permit the passage of air through the air hole even when the cap is securely held in place. Although the radius of the arms is chosen to provide an interference fit with the walls of the air hole 18, variations in the relative sizes of the shaft and air hole will occur. In order to maintain an interference fit in spite of moderate variations in sizes of the shaft and air hole, the arms are provided with narrow ridges 40 on their radially outermost surfaces. The fact that the ridges 40 are narrow means that they can be compressed or can compress small regions of the air hole walls with a minimum of applied force, so that even if there is considerable interference in the fit between the shaft and air hole the cap will not be very difficult to insert into place. In addition, the shaft 34 is tapered in width or diameter so that it has a progressively greater width at positions progressively closer to the top portion 28. As a result, the beginning of shaft insertion is relatively easy, so that the shaft extends accurately along the length of the air hole as the portions of greatest interference with the air hole move into the air hole. The tapering is small enough so that the shaft does not tend to "pop up" out of the hole.

The top portion 28 of the cap has several spacer projections 42 depending from the bottom surface 32 thereof. These projections 42 which are spaced by a distance S radially out from the shaft 34, assure an even distribution of pressured air onto the upper face 14 of the form. When the cap is fully installed and the center 30*c* is pressed down, the projections 42 will seat against the upper form wall 14. As a result, the spaces 44 between the projections 42 will remain open and form passageways for the outflow of pressured air. The projections 42 form several passageways 44 uniformly spaced about the center of the cap that assure a uniform distribution of air pressure. The cap 20 is effective in sealing out grout leakage, because the periphery of the top forms a good seal with the upper wall 14 of the form. A land 46 is formed on the bottom surface 42 at the periphery thereof, the land lying substantially in an imaginary plane perpendicular to the shaft 34, so that the land has a considerable surface engagement with the form wall 14 to provide a good seal therewith.

When air is blown through the air hole, the air tends to move in all directions away from the cap. As a result, a layer of pressured air is distributed in a somewhat uniform manner along the upper surface of the upper form wall 14, that tends to push down all regions of the wall. The upper wall 14 tends to buckle down and to shove down the entire form a small distance. A somewhat uniform distribution of air is important, because if only one side of the top wall of the form were pushed down, the form might become wedged in the concrete and removal might be even more difficult. The fact that the cap tends to direct air uniformly in numerous directions from the air hole means that uniform release of the form is encouraged.

Thus, the invention provides a device for sealing the air hole of a concrete form rapidly and in a manner that indicates whether or not a secure mounting has been achieved. This is accomplished by the use of a meniscus cap with a shaft that can engage the walls of the air hole in an interference fit so that the dome of the cap can be dimpled and can remain dimpled when securely held in place. The dimpling of the dome causes the periphery of the dome to press securely against the form even if the form deforms slightly or the cap moves up slightly. The shaft has a plurality of arms radiating from its center so the space between the arms provides air passageways, and the arms have narrow ridges on their outsides for encouraging a moderate interference fit through a range of sizes of the air hole for a shaft of predetermined size. The meniscus top of the cap has projections lying at positions spaced outwardly from the shaft, that provide passageways for the outward flow of air between the form and concrete and which encourage a more uniform outward air flow for better release of the form.

Although particular embodiments of the invention have been described and illustrated herein, it is recognized that modifications and variations may readily occur to those skilled in the art and consequently it is intended that the claims be interpreted to cover such modifications and equivalents.

What is claimed is:

1. A method for sealing and stripping a form of a type which has an air hole extending through a wall of the form comprising:

inserting through the air hole in an interference fit with the walls thereof, the shaft of a cap which has a thin dome with a concave inner surface at one end of the shaft, and depressing the center of the dome towards the form wall to deform the dome so it has a central dimple;

pouring concrete over the form and allowing it to at least partially set; and applying a gas conduit to said air hole at the inside of the form and blowing gas under pressure therethrough to provide a layer of pressured gas between the concrete and form wall to loosen the form.

* * * * *